US005868267A

United States Patent [19]

Taylor

[11] Patent Number: 5,868,267

[45] Date of Patent: Feb. 9, 1999

[54] REFUSE CONTAINER LID

[76] Inventor: Craig V. Taylor, 22502 S. Summit Ridge Cir., Chatsworth, Calif. 91311

[21] Appl. No.: 858,349

[22] Filed: May 19, 1997

[51] Int. Cl.[6] ..... B65D 43/24

[52] U.S. Cl. ..... 220/335; 220/343; 220/908; D34/11

[58] Field of Search ..... 220/335, 342, 220/343, 908, 909; D34/11

[56] References Cited

U.S. PATENT DOCUMENTS

| | | | |
|---|---|---|---|
| D. 304,633 | 11/1989 | Taylor . | |
| D. 319,326 | 8/1991 | Taylor . | |
| D. 326,943 | 6/1992 | Taylor . | |
| D. 340,560 | 10/1993 | Taylor . | |
| D. 362,325 | 9/1995 | Taylor . | |
| D. 363,584 | 10/1995 | Goodwin . | |
| 3,140,344 | 7/1964 | Slater et al. | 220/335 X |
| 3,866,936 | 2/1975 | Hedges | 220/908 X |
| 3,979,007 | 9/1976 | Thornbloom, Jr. | 220/335 X |
| 4,114,236 | 9/1978 | Vandervort | 220/335 X |
| 4,148,411 | 4/1979 | Hodge et al. . | |
| 4,558,799 | 12/1985 | Hammond | 220/343 |
| 4,771,940 | 9/1988 | Taylor . | |
| 4,972,966 | 11/1990 | Craft, Jr. | 220/264 |
| 5,248,057 | 9/1993 | Taylor . | |
| 5,447,251 | 9/1995 | Taylor . | |
| 5,564,586 | 10/1996 | Goodwin . | |
| 5,673,811 | 10/1997 | Dickinson et al. | 220/331 |

*Primary Examiner*—Stephen K. Cronin
*Attorney, Agent, or Firm*—Oppenheimer Wolff & Donnelly LLP

[57] ABSTRACT

A lid assembly for a refuse container includes a plurality of lid members, a pivotal attaching mechanism, and a cam-shaped lobe integrally formed on each lid member. The lid members each include a pivoting edge, a curved edge, and a surface complementary to at least a portion of an upper surface of the container. Each lid member includes a curved inner surface bound on opposing ends thereof by the pivoting edge and the curved edge. The pivotal attaching mechanism is adapted to attach the pivoting edges to the upper surface at a predetermined distance therefrom. The cam-shaped lobes are formed on the pivoting edge of each lid member and adapted to allow a pivotal motion of each lid member relative to the container and to contact the upper surface at a predetermined angle between the complementary surfaces and the upper surface, with the predetermined angle depending upon the predetermined distance and the shape of the lobes.

20 Claims, 6 Drawing Sheets

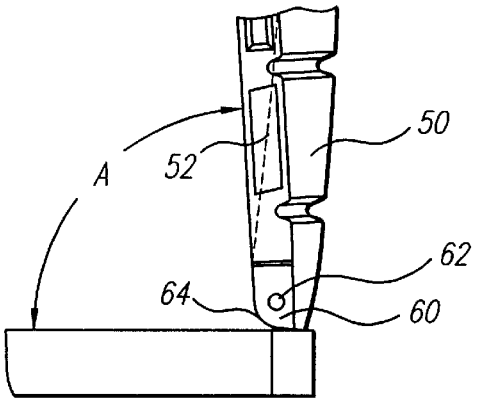
FIG. 8
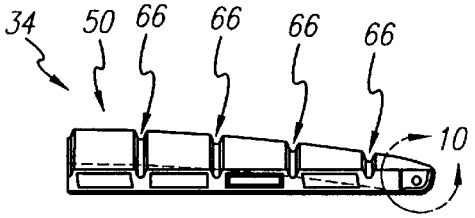
FIG. 9
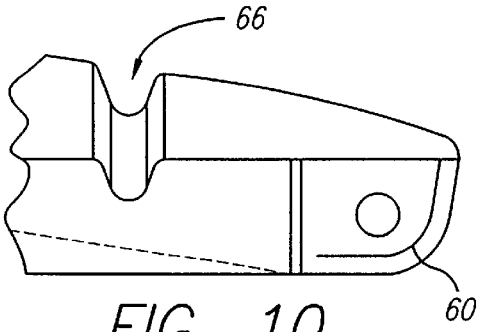
FIG. 10
FIG. 11
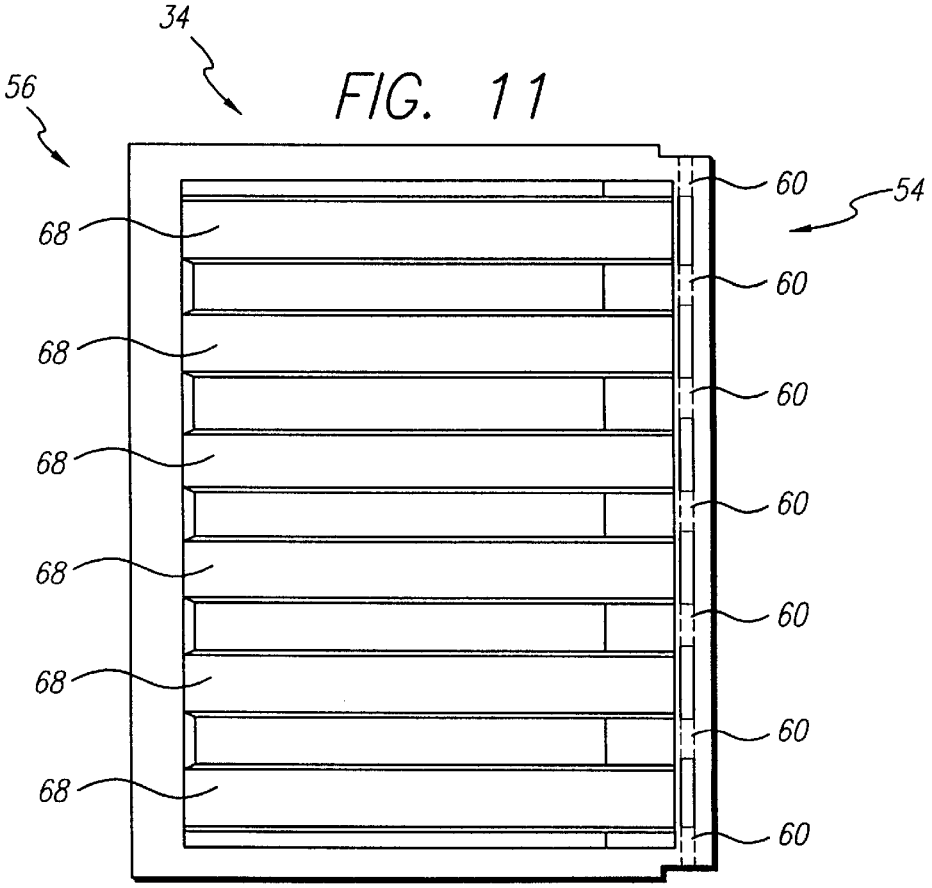

REFUSE CONTAINER LID

BACKGROUND OF THE INVENTION

1. Field of the Invention

The present invention relates to a lid assembly for a refuse container and, more particularly, a lid assembly including curved lid members with integrally formed cam-shaped lobes adapted to limit pivotal motion of the lid members relative to the container to which they are pivotally attached.

2. Description of the Related Art

Prior art lid assemblies for use with refuse containers such as dumpsters suffer from a number of deficiencies. When the containers are raised and turned such that their contents can spill into a garbage truck, it is necessary to provide a lid assembly which will open for this purpose. It is also desirable to provide a mechanism which ensures that lid members which are attached to a refuse container are not damaged during the refuse dumping process and which close after the container is returned to the ground. Furthermore, it is desirable to provide a lid assembly which is designed to optimally facilitate the egress of refuse from the container while simultaneously achieving the foregoing objectives. No known lid assembly is designed which protects lid members from damage during the refuse dumping process, maximizes the flow of refuse from the container into the refuse truck, and ensures that the lid members return to a closed position after the container is returned to the ground. Thus, an objective of the present invention is to provide a simple, durable and economical lid assembly for a refuse container embodying these features.

SUMMARY OF THE INVENTION

In one aspect of the present invention, a lid assembly for a refuse container includes two lid members, a pivotal attaching mechanism, and a cam-shaped lobe integrally formed on each lid member. The two lid members each include a pivoting edge, a curved edge, and a surface complementary to at least a portion of an upper surface of the container. Each lid member includes a curved inner surface bound on opposing ends thereof by the pivoting edge and the curved edge. The pivotal attaching mechanism is adapted to attach the pivoting edges to the upper surface at a predetermined distance therefrom. The cam-shaped lobes are formed on the pivoting edge of each lid member and adapted to allow a pivotal motion of each lid member relative to the container and to contact the upper surface of the container at a predetermined angle between the complementary surfaces and the upper surface. The cam-shaped lobes are formed such that the predetermined angle is determined by the predetermined distance. The cam-shaped lobes are formed such that the pivotal motion is limited to a range of motion between a closed position where the complementary surfaces are supported by the upper surface and where the curved edges substantially abut, and an open position where the complementary surfaces form angles of less than 90 degrees with the upper surface.

In another aspect of the present invention, the lid assembly for a refuse container includes a plurality of lid members pivotally attached to an upper surface of a container and mechanisms for limiting pivotal ranges of motion of the lid members. Each lid member includes at least one surface complementary to at least a portion of the upper surface and at least one curved edge. The mechanisms are adapted to limit the pivotal ranges of motion of the lid members between a closed position where the complementary surfaces are supported by the upper surface and where the curved edges substantially abut and an open position where the complementary surfaces form angles of less than 90 degrees with the upper surface.

In another aspect of the present invention, the lid assembly for a refuse container includes a curved lid member pivotally attached to an upper surface of a container and a mechanism for limiting a pivotal range of motion of the lid member. The lid member includes at least one surface complementary to at least a portion of the upper surface. The mechanism is adapted to limit the pivotal range of motion of the lid member between a closed position where the at least one complementary surface is supported by the upper surface and an open position where the at least one complementary surface forms an angle of less than 90 degrees with the upper surface.

In another aspect of the present invention, the lid assembly for a refuse container includes a lid member, a pivotal attaching mechanism, and a cam-shaped lobe. The lid member includes a pivoting edge and a surface complementary to at least a portion of an upper surface of a container. The pivotal attaching mechanism is adapted to attach the pivoting edge to the upper surface. The cam-shaped lobe is formed on the pivoting edge and adapted to allow a pivotal motion of the lid member relative to the container and to contact the upper surface at a predetermined angle between the complementary surface and the upper surface.

In accordance with a preferred embodiment of the present invention, the cam-shaped lobes extend along at least 50 percent, and preferably along substantially along all of the length of the pivoting edge of the lid or lids. With the lids being formed of high strength, but somewhat flexible plastic, the use of camming surfaces on a substantial portion of the length of the lid ensures that desired angle of opening obtains, even under adverse conditions.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 8 is an enlarged portion of FIG. 7 showing the cam-shaped lobe of the lid member in greater detail;

FIG. 9 is a front view of one of the lid members shown in FIG. 6;

FIG. 10 is an enlarged portion of FIG. 9 showing the cam-shaped lobe of the lid member in greater detail;

FIG. 11 is a bottom view of the lid member of FIG. 9;

and

Figure 6:
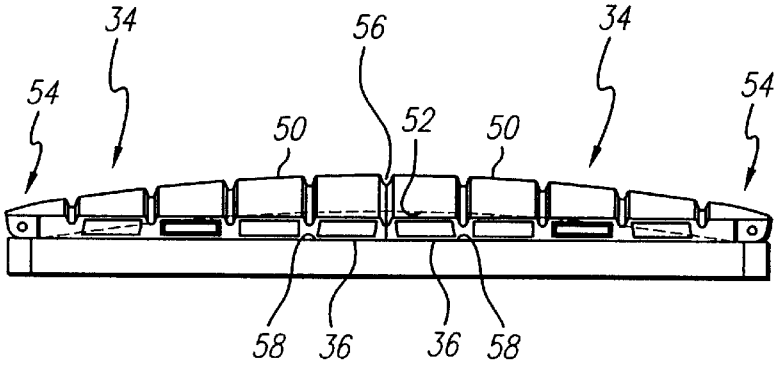
FIG. 6 is a front view of the lid assembly of FIG. 1 shown in its closed position.
Figure 20:
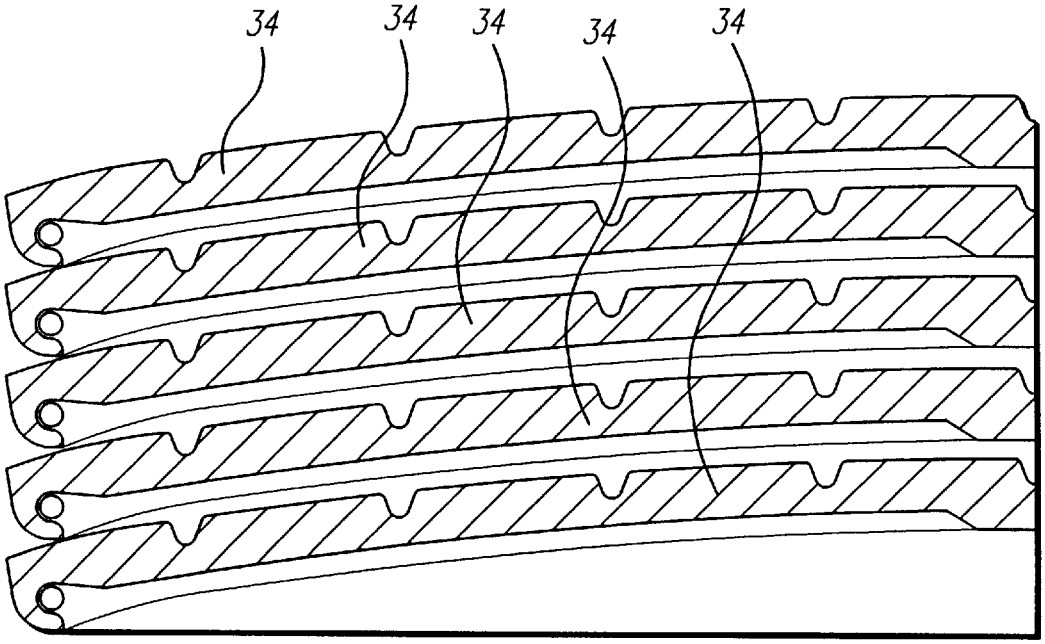

FIG. 20 is a cross-sectional front view a plurality of the lid members of FIG. 6 stacked in a nested configuration.

DETAILED DESCRIPTION OF THE PREFERRED EMBODIMENTS

Figure 1:
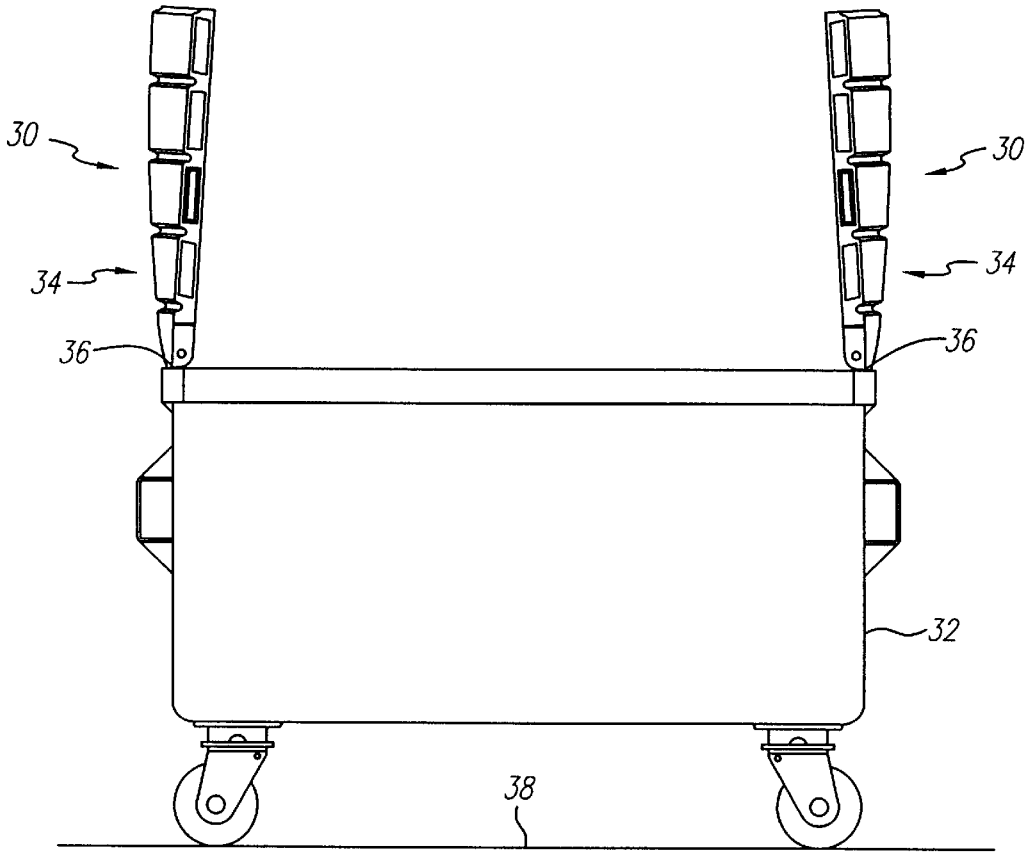
FIG. 1 is a partial cross-sectional front view of an exemplary preferred embodiment of the lid assembly of the present invention shown attached to a refuse container.

FIG. 1 illustrates an exemplary preferred embodiment of a lid assembly 30 according to the present invention shown attached to a refuse container 32. In the illustrated preferred embodiment, the lid assembly 30 includes two lid members 34 which are pivotally attached to an upper surface 36 of the container 32. In the interest of simplifying FIG. 1, the upper surface 36 is shown as being substantially parallel to the ground 38. However, it should be appreciated that the subject matter of the present invention additionally and particularly contemplates a refuse container 32 where the upper surface 36 increases in distance from the ground 38 moving from the front of the container to the rear of the container, e.g., a side-hinged, front end loader (FEL) container.

Figure 2:
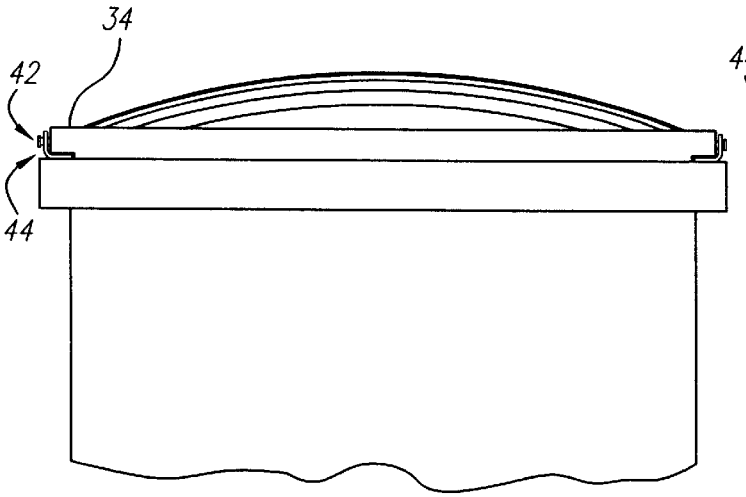
FIG. 2 is a left side view of the lid assembly of FIG. 1 in a closed position showing an attaching mechanism for attaching the lid member to the refuse container.
Figure 3:
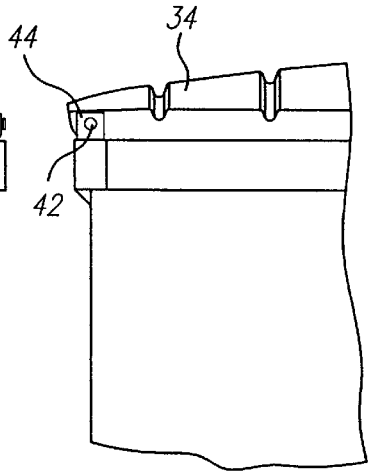
FIG. 3 is a cross-sectional front view showing a hinge bracket of the attaching mechanism of FIG. 2 secured to the refuse container.
Figure 4:
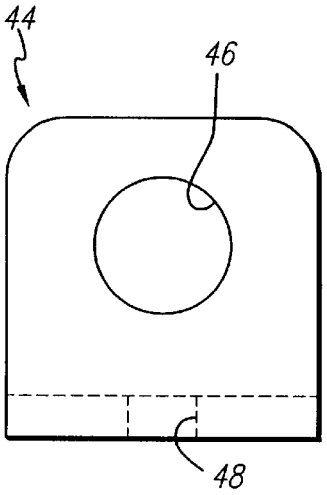
FIG. 4 is a detailed front view of the hinge bracket of FIG. 2.
Figure 5:
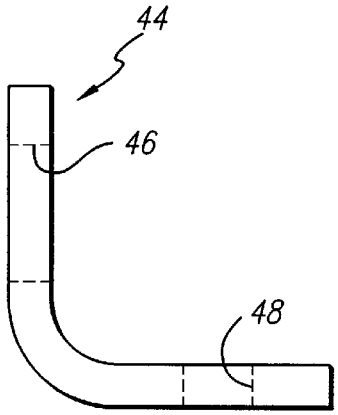
FIG. 5 is a detailed side view of the hinge bracket of FIG. 2.

The lid assembly 30 additionally includes a pivotal attaching mechanism 40 for pivotally attaching each lid member 34 to the upper surface 36 of the refuse container 32. As shown in FIGS. 2 and 3, the pivotal attaching mechanism 40 comprises, for example, a hinge rod 42 and two hinge brackets 44 for each lid member 34. A preferred rod 42 has a ¾ inch outer diameter. The hinge brackets 44 are formed as shown in FIGS. 4 and 5 with a cylindrical bore 46 appropriately sized, e.g., with a 49/64 inch inner diameter, to receive the rod 42. The hinge brackets 44 further include a bored and/or threaded channel 48 through which a bolt, screw or other conventional fastening mechanism is employed to secure the hinge brackets 44 to the upper surface 36 of the refuse container 32.

Referring to FIG. 6, the lid assembly 30 is shown with its two lid members 34 in a closed position. Generally, each lid member 34 includes a top surface 50 and a bottom surface 52 and is curved in shape. Each lid member 34 includes a pivoting edge 54, a curved edge 56, and surfaces 58 complementary to at least a portion of the upper surface 36 of the refuse container 32. When in the illustrated closed position, the complementary surfaces 58 are supported by the upper surface 36 and the curved edges 56 substantially abut as shown in FIG. 6. It should be appreciated that the subject matter of the present invention additionally contemplates lid members 34 where the complementary surfaces 58 are not necessarily flush with the upper surface 36 or directly supported thereby.

Another key aspect of the present invention is the generally "dome-like" shape of the lid assembly 30 when in its closed position. It has been observed that the lid assembly configuration shown in FIG. 6 has superior load (e.g., from the weight of snow on the lid members 34) bearing capabilities as compared to conventional metal lid members that have a flat or planar top surface. Such conventional lid members bend or deform when sufficiently large loads are applied to them and, as a result, collapse into the container.

Figure 7:
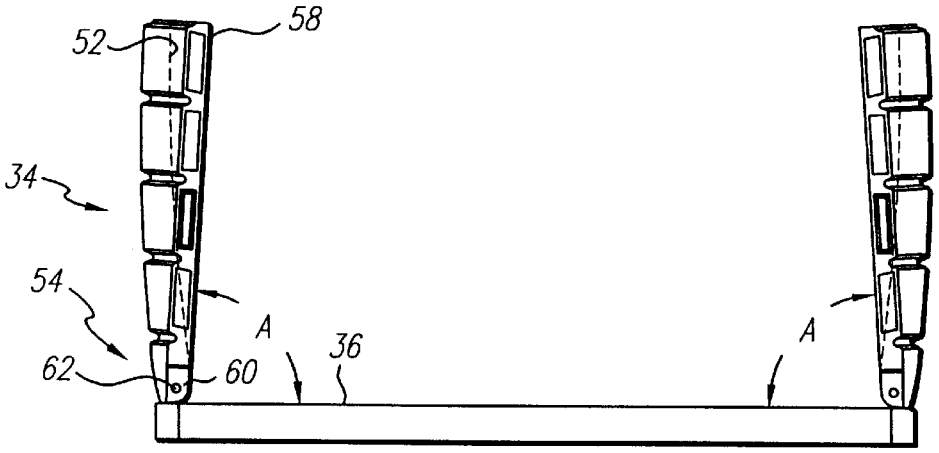
FIG. 7 is a front view of the lid assembly of FIG. 1 shown in its open position.

Referring to FIGS. 7 and 8, the lid assembly 30 is shown with its two lid members 34 in an open position. The pivoting edge 54 is preferably formed with a cam-shaped lobe 60 which is adapted to allow a pivotal motion of each lid member 34 relative to the refuse container 32 or, more specifically, about a pivoting axis 62 at the center of the rod 42. In the exemplary preferred lid assembly 30, the lid members 34 are formed from a flexible polyethylene plastic and the lobes 60 are integrally formed thereon. For example, the lid members 34 may be formed of high strength plastic as disclosed in my U.S. Pat. No. 4,771,940, issued Sep. 20, 1988. However, it should be understood that the lid members 34 can be made from other flexible materials. Regarding the lobes 60, they may be formed as a series of lobes or as a single lobe for most of the length of the pivoting edge 54 of each lid member 34. Moreover, the lobes 60 are not necessarily integrally formed on the lid members 34 and may be separately manufactured from the lid members 34 and subsequently attached thereto.

As shown in FIG. 8, the lobes 60 include an outer surface 64 which varies in distance from the pivoting axis 62. Generally, the portion of the outer surface 64 adjacent to the top surface 50 of the lid member 34 is further from the pivoting axis 62 than the portion of the outer surface 64 near the bottom surface 52. In its open position, the complementary surfaces 58 preferably form an angle "A" of less than 90 degrees with the upper surface 36. A key aspect of the present invention is that the lobes 60 are shaped such that the maximum angle "A" is predetermined and limited by frictional contact between the lobes 60 and the upper surface 36. Thus, the lid members 34 will not swing open too far when the refuse container 32 is turned upside down and lowered into a dumpster, thereby potentially resulting in damage to the lid members 34 caused by contact with the sides of the dumpster.

Another key aspect of the present invention is that the pivotal attaching mechanism 40 serves to position the pivoting axis 62 of the lid member 34 at a predetermined distance from the upper surface 36. The ability to accurately establish a desired maximum angle "A" depends upon being able to control the aforementioned predetermined distance. For this reason, a sturdy, metal rod 42 with a ¾ inch diameter is preferably employed.

Still another key aspect of the present invention is the curved shape of the lid members 34. Generally, the top surface 50 of each lid member 34 is convex while the bottom surface is concave. As best illustrated in FIG. 7, the angle between the bottom surface 52, at the center of the lid member 34, and the upper surface 36 is greater than the predetermined angle "A". This allows the trash or refuse to fall from the upside down container 32 while the lid assembly 30 is in its open position with less restriction. Conventional lid assemblies where a mechanical stop is employed to establish a maximum angle between the bottom surface of a flat lid member and the upper surface of a refuse container (of, for example, 85 degrees) suffer from a "funnel effect" whereby the trash stream damages the lid members and shortens their lives. The lid assembly 30 of the present invention addresses this problem by providing an open position where the angle between the bottom surface 52, at the center of the lid member 34, and the upper surface 36 is approximately 90 degrees, thereby substantially eliminating contact between the lid members 34 and the trash stream.

Still another advantage of the curved lid members 34 is that their center of gravity facilitates an automatic lid closure while the refuse container 32 is being lowered back to the ground after the refuse therein has been dumped. Furthermore, the curved shape of the lid members 34 prevents a lid whip lash effect when the lid members 34 are first thrown open during dumping.

Figure 12:
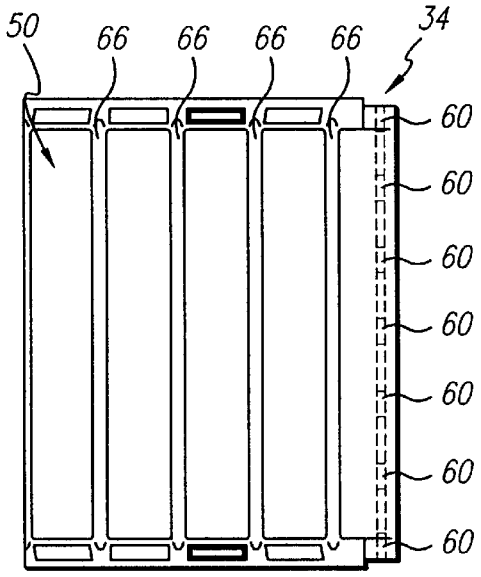
FIG. 12 is a top view of the lid member of FIG. 9.
Figure 13:
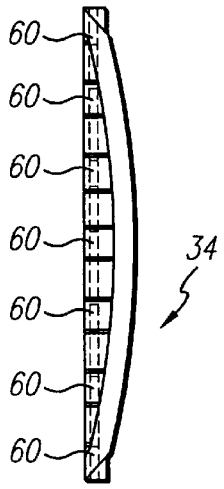
FIG. 13 is a left side view of the lid member of FIG. 12.
Figure 14:
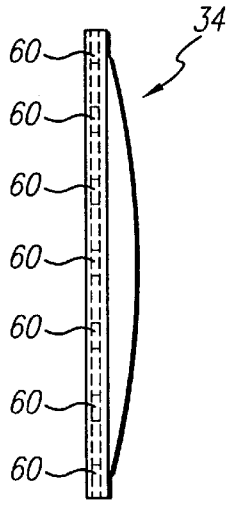
FIG. 14 is a right side view of the lid member of FIG. 12.

Referring to FIGS. 9 –13, and to FIGS. 9 and 12 in particular, the top surface 50 preferably includes a plurality of substantially parallel grooves 66 formed therein as shown. Referring to FIG. 11, the bottom surface 52 preferably includes a plurality of substantially parallel grooves 68 formed therein spanning from the pivoting edge 54 to the curved edge 56 of the lid member 34. This formation of the grooves 68 facilitates a more efficient egress of refuse from the container 32.

The lid members 34 can be constructed in a single or double wall design. In a single wall design, the grooves 66 are preferably oriented to run from the pivot edge 54 to the curved edge 56 to accommodate the trash stream flow direction.

Figure 16:
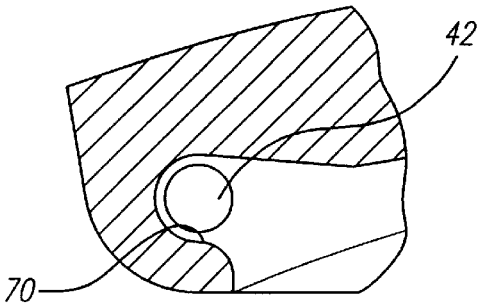
FIG. 16 is an enlarged portion of FIG. 15 showing the cam-shaped lobe of the lid member in greater detail.
Figure 17:
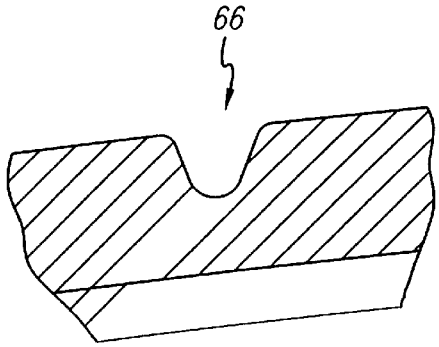
FIG. 17 is an enlarged portion of FIG. 15 showing a groove in the top surface of the lid member in greater detail.
Figure 15:
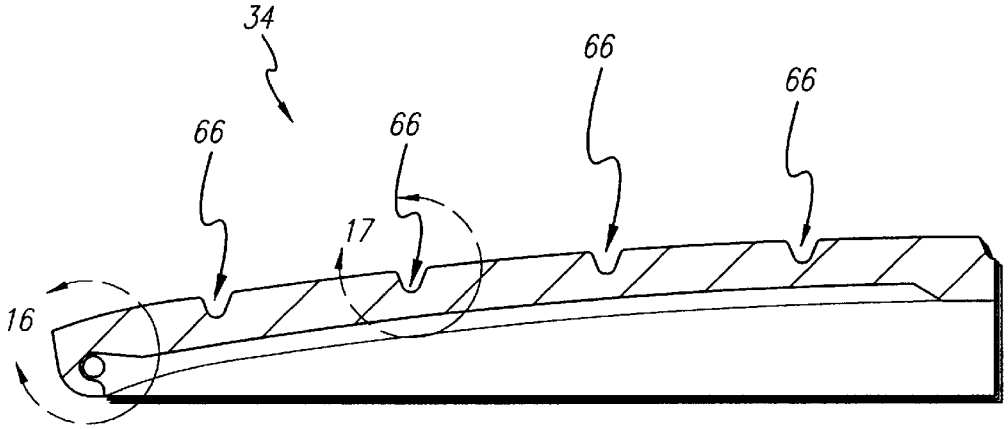
FIG. 15 is front cross-sectional view of one of the lid members shown in FIG. 6.
Figure 18:
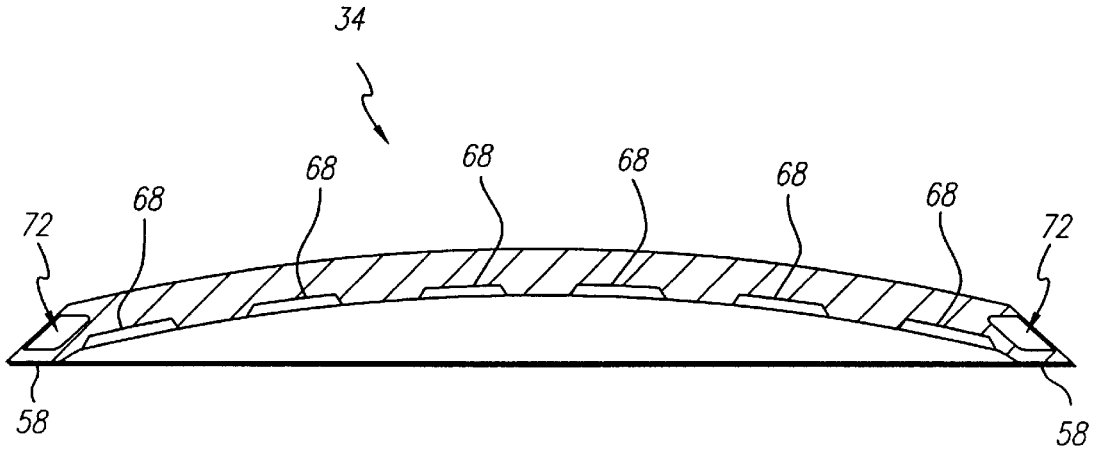
FIG. 18 is a right side view of the lid member of FIG. 15.

FIGS. 15 and 16 provide cross-sectional views of the preferred lid member 34 and particularly illustrate that the lobes 60 are formed with an inner surface 70 sized to be fitted around the rod 42 as shown. FIGS. 17 and 18 respectively illustrate exemplary contours for the grooves 66, 68. It should be understood that the lid members 34 can be made without any grooves or with grooves differing in shape, arrangement, depth, etc. Referring to FIG. 18, each lid member 34 preferably includes two recessed handles 72 formed adjacent to the surfaces 58 as shown. As may be readily appreciated, other handle configurations, preferably those which do not significantly project from the lid member 34, can be employed.

Figure 19:
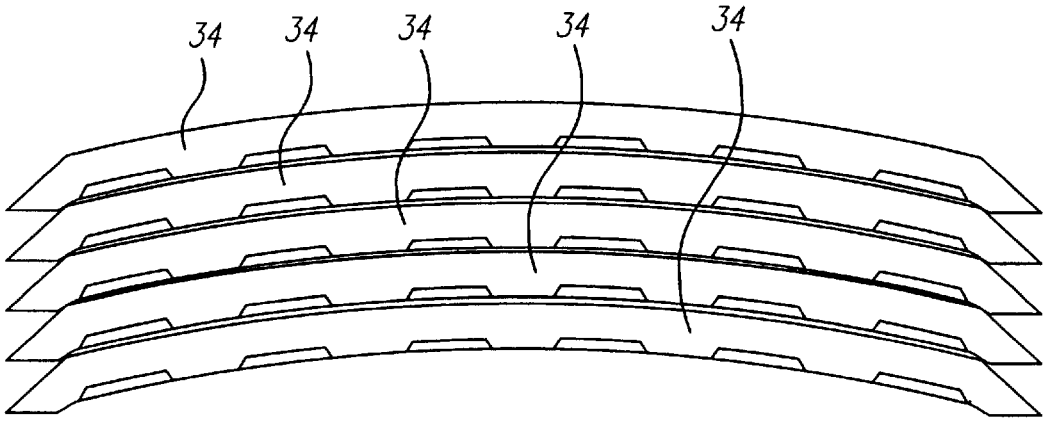
FIG. 19 is a cross-sectional right view a plurality of the lid members of FIG. 6 stacked in a nested configuration.

As shown in FIGS. 19 and 20, an additional aspect of the present invention is that the top and bottom surfaces 50, 52 are contoured such that a plurality of the lid members 34 can be interfitted in a nested fashion. This facilitates more efficient shipping and storage.

It is noted in passing that certain specific dimensions, or other specific information are given relative to various preferred embodiments of the invention. It is to be understood that these dimensions are merely illustrative or representative of preferred embodiments, and that different dimensions may be employed to implement the present invention, without departing from the spirit and scope of the invention.

In conclusion, it is to be understood that the foregoing detailed description and the accompanying drawings illustrate the principles of the invention. However, various changes and modifications may be employed without departing from the spirit and scope of the invention. Thus, by way of example and not of limitation, it is contemplated that a lid assembly could include a single or more than two lid members. Furthermore, lid member curvatures other than those particularly disclosed can be employed while still deriving the benefits of the disclosed invention. Accordingly, the present invention is not limited to the specific forms shown in the drawings and described in detail hereinabove.

What is claimed is:

1. A lid assembly for a refuse container comprising:

two lid members each including a pivoting edge, a curved edge, and a surface complementary to at least a portion of an upper surface of a container, each said lid member including a curved inner surface bound on opposing ends thereof by said pivoting edge and said curved edge;

means for pivotally attaching said pivoting edges to the upper surface at a predetermined distance therefrom; and a cam-shaped lobe formed on said pivoting edge of each said lid member and adapted to allow a pivotal motion of each said lid member relative to the container and to contact the upper surface at a predetermined angle between said complementary surfaces and the upper surface, said cam-shaped lobes being formed such that said predetermined angle is determined by said predetermined distance, said cam-shaped lobes being formed such that said pivotal motion is limited to a range of motion between a closed position where said complementary surfaces are supported by the upper surface and where said curved edges substantially abut and an open position where said complementary surfaces form angles of less than 90 degrees with the upper surface.

2. A lid assembly for a refuse container comprising:

a plurality of lid members pivotally attached to a container with an upper surface, each said lid member including at least one surface complementary to at least a portion of the upper surface and at least one curved edge; and a lobe member attached to each of said lid members said lobe members as attached limiting pivotal ranges of motion of said lid members between a closed position where said complementary surfaces are supported by the upper surface and where said curved edges substantially abut and an open position where said lobe members make contact with the upper surface.

3. The lid assembly for a refuse container of claim 2 wherein each of said lid members is formed with a handle.

4. The lid assembly for a refuse container of claim 2 wherein:

each of said lid members includes a pivoting edge pivotally attached to the upper surface.

5. The lid assembly for a refuse container of claim 4 wherein each said lid member includes a top surface and a bottom surface.

6. The lid assembly for a refuse container of claim 5 wherein each said bottom surface is concavely curved spanning from said pivoting edge to said curved edge of its lid member.

7. The lid assembly for a refuse container of claim 5 wherein:

said at least one complementary surface of each said lid members comprises two surfaces on opposing ends of each said lid member; and each said bottom surface is concavely curved spanning between said two opposing surfaces of its lid member.

8. The lid assembly for a refuse container of claim 5 wherein said bottom surface is formed with grooves spanning from said pivoting edge to said curved edge of its lid member.

9. The lid assembly for a refuse container of claim 5 wherein said top surfaces and said bottom surfaces are contoured such that said lid members could be interfitted in a nested fashion.

10. A lid assembly for a refuse container comprising;

a curved lid member pivotally attached to a container with an upper surface, said lid member including at least one surface complementary to at least a portion of the upper surface; and a cam-shaped lobe integrally formed as a part of said lid member, said lobe limiting a pivotal range of motion of said lid member between a closed position where said at least one complementary surface is supported by the upper surface and an open position where said lobe makes contact with the upper surface.

11. The lid assembly for a refuse container of claim 10 wherein said lid member is formed from a flexible material.

12. The lid assembly for a refuse container of claim 10 wherein said lid member is formed from a high strength molded plastic.

13. The lid assembly for a refuse container of claim 10 wherein said lid member includes a top surface and a bottom surface.

14. The lid assembly for a refuse container of claim 13 wherein said top surface is convex.

15. The lid assembly for a refuse container of claim 13 wherein said bottom surface is concave.

16. The lid assembly for a refuse container of claim 13 wherein said top surface and said bottom surface are contoured such that a plurality of said lid members could be interfitted in a nested fashion.

17. A lid assembly for a refuse container comprising;

a lid member pivotally attached to a container with an upper surface, said lid member including a pivoting edge and a surface complementary to at least a portion of the upper surface, said pivoting edge including a cam-shaped lobe shaped to allow a pivotal motion of said lid member relative to the container such that said lobe contacts the upper surface when said lid member is in an open position.

18. The lid assembly for a refuse container of claim 17 wherein said cam-shaped lobe is formed along substantially an entire length of said pivoting edge.

19. The lid assembly for a refuse container of claim 17 wherein said cam-shaped lobe is formed along at least 50 percent of said pivoting edge.

20. The lid assembly for a refuse container of claim 17 wherein said cam-shaped lobe is formed such that the pivotal motion is between a closed position where said complementary surface is supported by the upper surface and an open position where said complementary surface forms an angle of less than 90 degrees with the upper surface.

* * * * *